US007379678B2

(12) United States Patent
Motoyama et al.

(10) Patent No.: US 7,379,678 B2
(45) Date of Patent: May 27, 2008

(54) IMAGE FORMING APPARATUS AND CONTROL METHOD THEREFOR

(75) Inventors: Eiichi Motoyama, Tokyo (JP); Yoshihito Osari, Tokyo (JP); Kuniyasu Kimura, Toride (JP); Hiroaki Tomiyasu, Toride (JP); Takahiko Yamaoka, Kashiwa (JP); Yuichi Yamamoto, Abiko (JP)

(73) Assignee: Canon Kabushiki Kaisha (JP)

( * ) Notice: Subject to any disclaimer, the term of this patent is extended or adjusted under 35 U.S.C. 154(b) by 177 days.

(21) Appl. No.: 11/442,945

(22) Filed: May 30, 2006

(65) Prior Publication Data

US 2006/0269300 A1 Nov. 30, 2006

(30) Foreign Application Priority Data

May 31, 2005 (JP) ..... 2005-159859

(51) Int. Cl.

| | |
|---|---|
| ***G03G 21/00*** | (2006.01) |
| ***G03G 15/00*** | (2006.01) |
| ***B65H 29/00*** | (2006.01) |
| ***B41J 29/38*** | (2006.01) |

(52) U.S. Cl. ..... 399/16; 399/361; 399/401; 271/278; 271/291; 271/186

(58) Field of Classification Search ..... None
See application file for complete search history.

(56) References Cited

U.S. PATENT DOCUMENTS

| | | | | |
|---|---|---|---|---|
| 6,330,425 | B1 * | 12/2001 | Ohuchi et al. | 399/401 |
| 2006/0269340 | A1 | 11/2006 | Osari | |

FOREIGN PATENT DOCUMENTS

| | | | | |
|---|---|---|---|---|
| JP | 5-131696 | A | | 5/1993 |
| JP | 10157212 | A | * | 6/1998 |
| JP | 11288197 | A | * | 10/1999 |
| JP | 2001-305918 | A | | 11/2001 |
| JP | 3334481 | B2 | | 8/2002 |
| JP | 2003175656 | A | * | 6/2003 |

* cited by examiner

*Primary Examiner*—Daniel J. Colilla
*Assistant Examiner*—N. Ha
(74) *Attorney, Agent, or Firm*—Rossi, Kimms & McDowell LLP

(57) ABSTRACT

An image forming apparatus that is capable of normally performing second side printing on a transfer material, even if the transfer material put on standby after completion of first side printing is pulled out by a user. A transfer material having image formed on its first side is fed until it is partly exposed to the outside of a printer, and is then fed to a refeeding path in the printer and further fed to a standby position prior to image formation on the second side of the transfer material. When it is detected that the transfer material caused to stop at the standby position is pulled out by a user, a warning to stop pulling out the transfer material is given to the user.

12 Claims, 9 Drawing Sheets

IMAGE FORMING APPARATUS AND CONTROL METHOD THEREFOR

BACKGROUND OF THE INVENTION

1. Field of the Invention

The present invention relates to an image forming apparatus and a control method therefor, and more particularly, to an image forming apparatus such as a copying machine or a printer for performing double-sided printing and a control method therefor.

2. Description of the Related Art

Conventionally, there has been known printers for performing double-sided printing by inverting a sheet after completion of first side printing on the sheet and then performing second side printing thereon. Such printers put the inverted sheet on standby on a conveying path in the case where the second side printing on the sheet cannot be started in predetermined timing after completion of the first side printing for a reason such as delay in developing image data for image formation on the second side. Most of such printers are designed to have a conveying path which is short in length for the sake of miniaturizing, so that the sheet is partly exposed to the outside of the printer body upon inversion of the sheet (refer to Japanese Patent Laid-Open No. 05-131696 for instance).

In these printers, when the second side printing on a sheet cannot be started in predetermined timing after completion of the first side printing, the sheet is made to be on standby and the sheet put on standby is partly exposed to the outside of the printer, as described above. When the sheet put on standby is of large size such as A3 in particular, the part of the sheet exposed to the outside of the printer body is so large that a user may mistakenly pull out the sheet, judging that printing is finished.

Thus, there has been proposed a technique of canceling a printing process when a user mistakenly pulls out a sheet during printing (refer to Japanese Laid-Open Patent Publication (Kokai) No. 2001-305918, for instance).

However, the proposed prior art cannot prevent a user from pulling out a sheet during printing. Even when the user is aware of printing being in progress while pulling out the sheet from the printer and then stops pulling it out, problems are caused such that the sheet cannot be normally fed, and images are displaced relative to the sheet so that the second side printing is not normally performed.

SUMMARY OF THE INVENTION

It is therefore an object of the present invention to provide an image forming apparatus capable of normally performing second side printing on an inverted transfer material in double-sided printing even if the inverted transfer material on standby is pulled out by a user after completion of first side printing on the transfer material and a control method therefor.

To attain the above object, in a first aspect of the present invention, there is provided an image forming apparatus comprising a sheet feeding device that feeds a transfer material, a receiving device that receives image data, an image forming device that forms an image on a first side and a second side of the fed transfer material based on the image data received by the receiving device, an inversion device that feeds the transfer material having the image formed on the first side thereof until the transfer material is partly exposed to outside of the image forming apparatus and then feeds the transfer material to a refeeding path in the image forming apparatus, a refeeding device that feeds the transfer material inverted by the inversion device to a standby position and causes the transfer material to stop at the standby position for image formation on the second side of the transfer material, a determining device that determines whether or not preparation for image formation on the second side of the transfer material is completed, a pullout detecting device that detects the transfer material caused to stop at the standby position by the refeeding device being pulled out by a user, and a warning device that gives the user a warning to stop pulling out the transfer material when the transfer material being pulled out is detected by the pullout detecting device.

Preferably, the pullout detecting device detects a degree of the transfer material being pulled out, and the warning device changes type of the warning according to the detected degree of the transfer material being pulled out.

More preferably, the refeeding device feeds the transfer material to the standby position based on the degree of the transfer material being pulled out detected by the pullout detecting device.

Preferably, the warning device notifies the user that image forming operation on the transfer material cannot be continued when it is detected by the pullout detecting device that the transfer material is completely pulled out.

Preferably, the image forming apparatus comprises a setting device that sets whether or not the warning device should give the warning.

Preferably, the warning device notifies the user that the transfer material is kept stopped at the standby position.

To attain the above object, in a second aspect of the present invention, there is provided a control method for an image forming apparatus comprising a sheet feeding step of feeding a transfer material, a receiving step of receiving image data, an image forming step of forming an image on a first side and a second side of the fed transfer material with the image forming apparatus based on the image data received in the receiving step, an inversion step of feeding the transfer material having the image formed on the first side thereof until the transfer material is partly exposed to outside of the image forming apparatus and then feeding the transfer material to a refeeding path in the image forming apparatus, a refeeding step of feeding the transfer material inverted in the inversion step to a standby position and causing the transfer material to stop at the standby position for image formation on the second side of the transfer material, a determining step of determining whether or not preparation for image formation on the second side of the transfer material is completed, a pullout detecting step of detecting the transfer material caused to stop at the standby position in the refeeding step being pulled out by a user, and a warning step of giving the user a warning to stop pulling out the transfer material when the transfer material being pulled out is detected in the pullout detecting step.

Preferably, the pullout detecting step detects a degree of the transfer material being pulled out, and the warning step changes type of the warning according to the detected degree of the transfer material being pulled out.

More preferably, the refeeding step feeds the transfer material to the standby position based on the degree of the transfer material being pulled out detected in the pullout detecting step.

Preferably, the warning step notifies the user that image forming operation on the transfer material cannot be continued when it is detected in the pullout detecting step that the transfer material is completely pulled out.

Preferably, the control method comprises a setting step of setting whether or not the warning should be given in the warning step.

Preferably, the warning device notifies the user that the transfer material is kept stopped at the standby position.

According to the present invention, when image data for image formation on the second side of a transfer material is not received, the transfer material after inversion is put on standby at a predetermined position, and a user is given a warning to stop pulling out the transfer material if pullout thereof by the user is detected. Therefore, in double-sided printing, the second side printing can be normally performed even if the sheet on standby is pulled out by the user after completion of the first side printing.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the accompanying drawings showing a preferred embodiment thereof.

Figure 1:
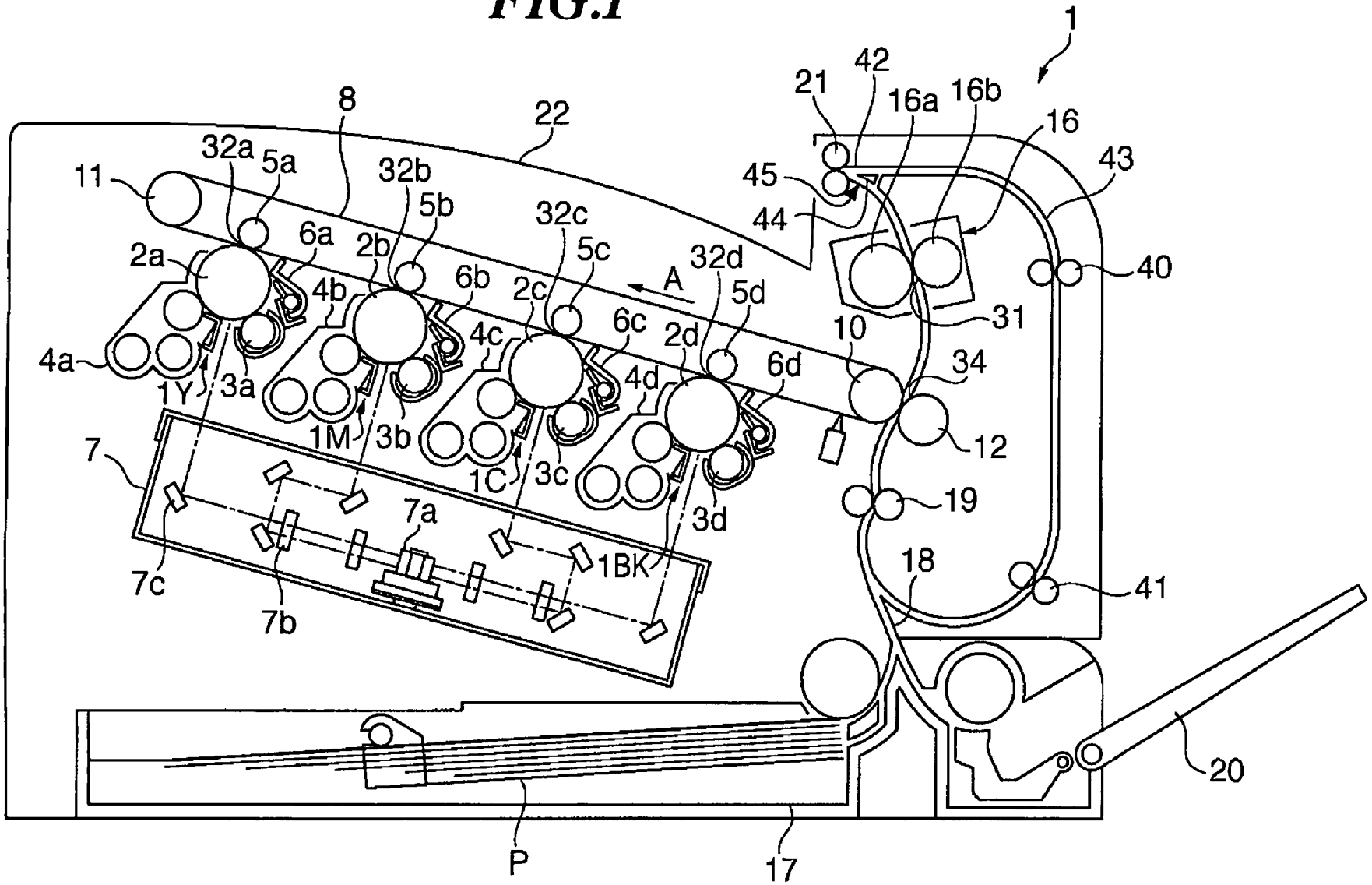
FIG. 1 is a sectional view schematically showing a configuration of a full-color printer as an image forming apparatus according to an embodiment of the present invention.

FIG. 1 is a sectional view schematically showing the construction of a full-color printer as an image forming apparatus according to an embodiment of the present invention.

In FIG. 1, the full-color printer 1 comprises an image forming sections 1Y, 1M, 1C and 1Bk for forming images in colors of yellow, magenta, cyan, and black, respectively. These four image forming sections 1Y, 1M, 1C and 1Bk are disposed in a line with a certain spacing.

The image forming sections 1Y, 1M, 1C and 1Bk comprise drum-shaped electrophotographic photo conductors as image carriers (referred to as "photosensitive drums" hereafter) 2*a* to 2*d*, primary chargers 3*a* to 3*d* as primary charging means, developing devices 4*a* to 4*d*, transfer rollers 5*a* to 5*d* as primary transfer means, and drum cleaner devices 6*a* to 6*d*.

The full-color printer 1 also comprises a laser exposure device 7 below the image forming sections 1Y, 1M, 1C and 1Bk, and further comprises an endless intermediate transfer belt 8 between the photosensitive drums 2*a* to 2*d* and the transfer rollers 5*a* to 5*d*.

The photosensitive drums 2*a* to 2*d* are each formed of OPC (Organic Photo Conductor) having a property of being negatively charged, and each have a photoconductive layer on a drum base made of aluminum. The photosensitive drums 2*a* to 2*d* are rotatively driven by a drive unit (not shown) at a predetermined process speed in a clockwise direction in FIG. 1. The primary chargers 3*a* to 3*d* charge surfaces of the photosensitive drums 2*a* to 2*d* evenly with a charge bias applied from a charge bias power supply (not shown) at a predetermined negative potential, respectively.

The developing devices 4*a* to 4*d* contain yellow toner, cyan toner, magenta toner, and black toner, respectively. The developing devices 4*a* to 4*d* attach the toners of the respective colors to electrostatic latent images formed on the photosensitive drums 2*a* to 2*d* so as to develop or visualize them as toner images. The transfer rollers 5*a* to 5*d* are in contact with the photosensitive drums 2*a* to 2*d* in primary transfer sections 32*a* to 32*d* via the intermediate transfer belt 8. The drum cleaner devices 6*a* to 6*d* include cleaning blades for removing the toners remaining on the photosensitive drums 2*a* to 2*d* after primary transfer.

The exposure device 7 includes a laser light emitting device 7*a*, polygon lenses 7*b*, reflecting mirrors 7*c* and the like. The exposure device 7 irradiates the photosensitive drums 2*a* to 2*d* charged by the primary chargers 3*a* to 3*d* with laser light according to image data input from an external apparatus. Thus, the electrostatic latent color images corresponding to the image data are formed on the photosensitive drums 2*a* to 2*d*. The intermediate transfer belt 8 is formed by films of dielectric resin such as polycarbonate, polyethylene terephthalate resin, or polyvinylidene fluoride resin.

The full-color printer 1 further comprises a counter roller 10, a tension roller 11, and a secondary transfer roller 12, wherein the counter roller 10 is disposed to be opposed to the secondary transfer roller 12.

The intermediate transfer belt 8 is disposed to be movable and to be opposed to top surfaces of the photosensitive drums 2*a* to 2*d*, and is stretched between the counter roller 10 and the tension roller 11. The counter roller 10 is in contact with the secondary transfer roller 12 in a secondary transfer section 34 via the intermediate transfer belt 8 to drive the intermediate transfer belt 8 in the direction of an arrow A in FIG. 1. The tension roller 11 is placed at a position opposed to the counter roller 10 across the primary transfer sections 32*a* to 32*d* so as to provide a tension to the intermediate transfer belt 8. The intermediate transfer belt 8 is disposed to be inclined at an angle of inclination of 15°, with the secondary transfer roller 12 side (that is, the secondary transfer section 34 side) thereof located below the other side thereof.

The full-color printer 1 further comprises a belt cleaning apparatus (not shown) disposed near the tension roller 11 outside the intermediate transfer belt 8. This belt cleaning apparatus removes and collects toners remaining on the intermediate transfer belt 8 after secondary transfer.

The full-color printer 1 further comprises a sheet feed cassette 17 having a transfer material (sheet) P housed therein, a manual sheet feed tray 20, a conveying path 18, a registration roller 19, a fixing device 16, a sheet discharging roller 21, a sheet discharge tray 22, a double-sided path (a refeeding path) 43, double-sided rollers 40, 41 and a flapper 44.

The sheet feed cassette 17 and the manual sheet feed tray 20 feed the transfer material P to the conveying path 18. The registration roller 19 feeds the transfer material P to the secondary transfer roller 12 in proper timing. The fixing device 16 includes a fixing roller 16*a* and a pressurizing roller 16*b* which are mutually in contact in a nip portion 31.

The discharging roller 21 discharges the transfer material P to the discharge tray 22 provided on the top surface of the full-color printer 1. When performing double-sided printing, a trailing edge of the transfer material P reaches an inversion position 42, and then the position of the flapper 44 is switched to the double-sided path 43 side and the discharging roller 21 rotates inversely so as to feed the transfer material P to the double-sided path 43. The double-sided rollers 40, 41 transfer the transfer material P in the double-sided path 43. The full-color printer 1 is designed such that the conveying path 18 along which the transfer material P is transferred is short in length for the sake of miniaturizing the apparatus, so that the transfer material P is partly exposed to the outside of the printer body upon inversion of the transfer material P.

Hereunder, an image forming operation of the full-color printer 1 for single-sided printing will be described.

First, when an image formation start signal is generated from the CPU of the full-color printer 1, the photosensitive drums 2*a* to 2*d* of the image forming sections 1Y, 1M, 1C and 1Bk are rotatively driven at a predetermined process speed. The photosensitive drums 2*a* to 2*d* are negatively charged uniformly by the primary chargers 3*a* to 3*d*.

The laser light emitting device 7*a* emits laser light according to respective color image data input from the external apparatus. The laser light emitted from the laser light emitting device 7*a* is radiated on each of the photosensitive drums 2*a* to 2*d* by way of the polygon lenses 7*b*, the reflecting mirrors 7*c* and the like. Thus, electrostatic latent images corresponding to the color image data are formed on the photosensitive drums 2*a* to 2*d*.

Next, in the image forming section 1Y, the developing device 4*a* is applied with a developing bias of the same polarity as charge polarity (negative polarity) of the photosensitive drum 2*a*. The developing device 4*a* attaches yellow toner to the electrostatic latent image formed on the photosensitive drum 2*a* to visualize the electrostatic latent image as a toner image. In the primary transfer section 32*a*, the yellow toner image on the photosensitive drum 2*a* is primary-transferred on the intermediate transfer belt 8 driven in the direction of an arrow A in FIG. 1 by the transfer roller 5*a* applied with a primary transfer bias of the polarity (positive polarity) reverse to that of the toner. The toner remaining on the photosensitive drum 2*a* after the primary transfer onto the intermediate transfer belt 8 is scraped off by the cleaning blade provided in the drum cleaner device 6*a* and is collected.

Next, the yellow toner image transferred onto the intermediate transfer belt 8 is moved toward the image forming section 1M. In the image forming section 1M, the toner image of magenta formed on the photosensitive drum 2*b* is transferred and superimposed on the yellow toner image transferred onto the intermediate transfer belt 8, as with the primary transfer in the image forming section 1Y.

Likewise, in the image forming sections 1C and 1Bk, the toner images of cyan and black formed on the photosensitive drums 2*c* and 2*d* are transferred and superimposed in sequence on the toner images of yellow and magenta having been transferred on the intermediate transfer belt 8. Thus, a full-color toner image is transferred on the intermediate transfer belt 8.

Next, the registration roller 19 feeds the transfer material P fed from the sheet feed cassette 17 or the manual sheet feed tray 20 to the secondary transfer section 34 in timing in which a front edge of the full-color toner image transferred on the intermediate transfer belt 8 reaches the secondary transfer section 34 as a result of movement of the intermediate transfer belt 8. In the secondary transfer section 34, the full-color toner image primary-transferred on the intermediate transfer belt 8 is secondary-transferred onto the transfer material P by the secondary transfer roller 12 to which the secondary transfer bias of the polarity reverse to that of the toner (positive polarity) is applied. The toner remaining after the secondary transfer on the intermediate transfer belt 8 is removed by a belt cleaning apparatus, not shown, and is collected.

Next, the transfer material P having the full-color toner image secondary-transferred thereon is fed to the nip portion 31. In the nip portion 31, the fixing roller 16*a* and the pressurizing roller 16*b* heat and pressurize the transfer material P on which the full-color toner image has been secondary-transferred, whereby the toner image on the transfer material P is thermally fixed. The discharging roller 21 discharges the transfer material P having the toner image thermally fixed thereon onto the discharge tray 22, thus completing the series of the image forming operations.

Hereunder, the image forming operation of the full-color printer 1 for the double-sided printing will be described.

The image forming operation for the double-sided printing is the same as that for the single-sided printing insofar as are concerned the procedures from the beginning to the step of thermally fixing the toner image onto the first side of the transfer material P by the fixing roller 16*a* and the pressurizing roller 16*b*.

Thereafter, the discharging roller 21 is caused to rotate forward to feed the transfer material P having the toner image thermally fixed on the first side thereof in the direction of the discharge tray 22, and is caused to stop rotating when a trailing edge of the transfer material P arrives at the inversion position 42, whereby the feeding of the transfer material P is stopped. Arrival of the transfer material at the inversion position 42 is determined by a sensor 45.

Next, the position of the flapper 44 is switched to the double-sided path 43 side. Subsequently, the discharging roller 21 rotates inversely to feed the transfer material P to the double-sided path 43 in which double-sided rollers 40, 41 feed the transfer material P in the direction of the registration roller 19. Thus, the transfer material P is fed to the secondary transfer section 34 in an inverted state.

The CPU of the full-color printer 1 generates an image formation start signal to start image formation on the second side of the transfer material P. Thus, respective color toner images are primary-transferred in sequence onto the intermediate transfer belt 8. The registration roller 19 feeds the inverted transfer material P to the secondary transfer section 34 in timing in which the front edge of the full-color toner image on the intermediate transfer belt 8 reaches the secondary transfer section 34.

Next, as in the case of the single-sided printing, the toner image primary-transferred onto the intermediate transfer belt 8 is secondary-transferred onto the transfer material P by the secondary transfer section 34. The toner image is thermally fixed on the transfer material P by the nip portion 31, and the transfer material P having the toner image thermally fixed thereon is discharged onto the discharge tray 22, thus completing the series of the image forming operation.

Figure 2:
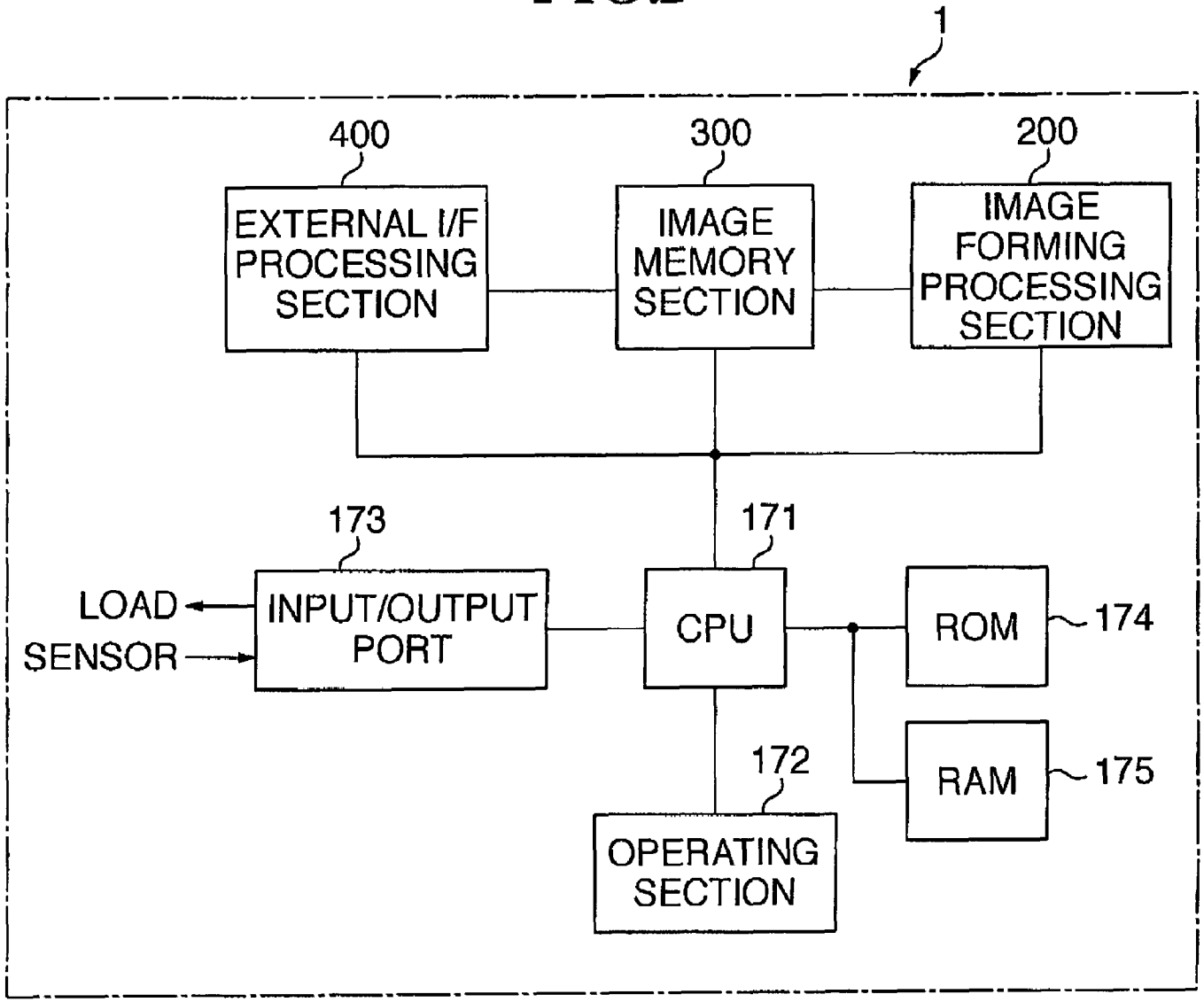
FIG. 2 is a block diagram showing an internal configuration of the full-color printer of FIG. 1.

FIG. 2 is a block diagram showing an internal configuration of the full-color printer 1 of FIG. 1.

In FIG. 2, the full-color printer 1 comprises a CPU 171 and also comprises an ROM 174, an RAM 175, an input/output port 173, an operating section 172, an image forming processing section 200, an image memory section 300, and an external I/F (interface) processing section 400, which are connected to the CPU 171 via an address bus and a data bus.

The CPU 171 controls the full-color printer 1. The ROM 174 stores a control program to be executed by the CPU 171. The RAM 175 is a work area used when the CPU 171 executes the control program and the like.

Connected to the input/output port 173 are various loads such as motors and clutches used for controlling the operation of the full-color printer 1, sensors for detecting positions of transfer material P, and the like. The CPU 171 controls signal input/output via the input/output port 173 according to the control program stored in the ROM 174, thereby performing the image forming operation.

The operating section 172 includes a display device and a key input device. An operator uses the key input device to instruct the CPU 171 to switch an image forming operation mode and a display. The CPU 171 displays the state of the full-color printer 1 and the settings of the operation mode by key input.

The external I/F processing section 400 and the image forming processing section 200 are connected to the image memory section 300. The external I/F processing section 400 transmits and receives the image data, processing data and the like to and from an external apparatus such as a PC (Personal Computer). The image memory section 300 performs an expansion process and temporary accumulation of image data, and the like. The image forming processing section 200 performs a process for causing the exposure device 7 to emit laser light corresponding to line image data transferred from the image memory section 300.

Figure 3:
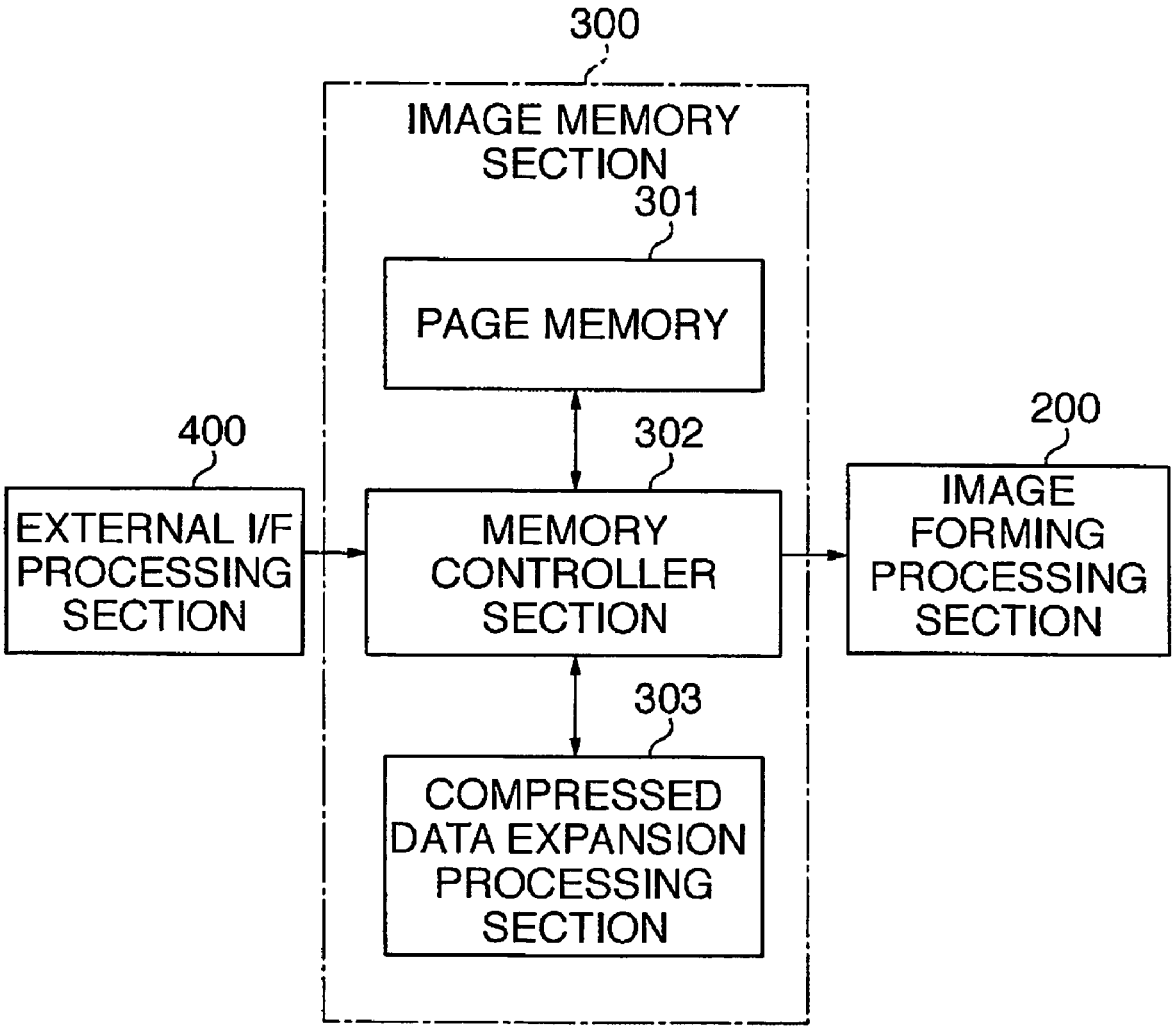
FIG. 3 is a block diagram showing the configuration of an image memory section of FIG. 2 in detail.

FIG. 3 is a block diagram showing the configuration of the image memory section 300 of FIG. 2 in detail.

In FIG. 3, the image memory section 300 comprises a memory controller section 302 connected to the external I/F processing section 400 and the image forming processing section 200, and comprises a page memory 301 and a compressed data expansion processing section 303 that are connected to the memory controller section 302.

The page memory 301 is implemented by a DRAM or other memory. The memory controller section 302 writes to the page memory 301 image data received from the external apparatus via the external I/F processing section 400. The memory controller section 302 reads image data written into the page memory 301 to the image forming processing section 200.

Furthermore, the memory controller section 302 determines whether or not image data received from the external apparatus via the external I/F processing section 400 is compressed data. When the image data received from the external apparatus is compressed data, the compressed data expansion processing section 303 performs the expansion process to the image data, and the memory controller section 302 writes the expanded image data to the page memory 301.

In addition, the memory controller section 302 generates a DRAM refresh signal for the page memory 301, arbitrates access to the page memory 301 for writing and reading data from the external I/F processing section 400 and to the image forming processing section 200, controls a write address and a read address of the page memory 301 and a read direction from the page memory 301, and performs other operation.

Figure 4:
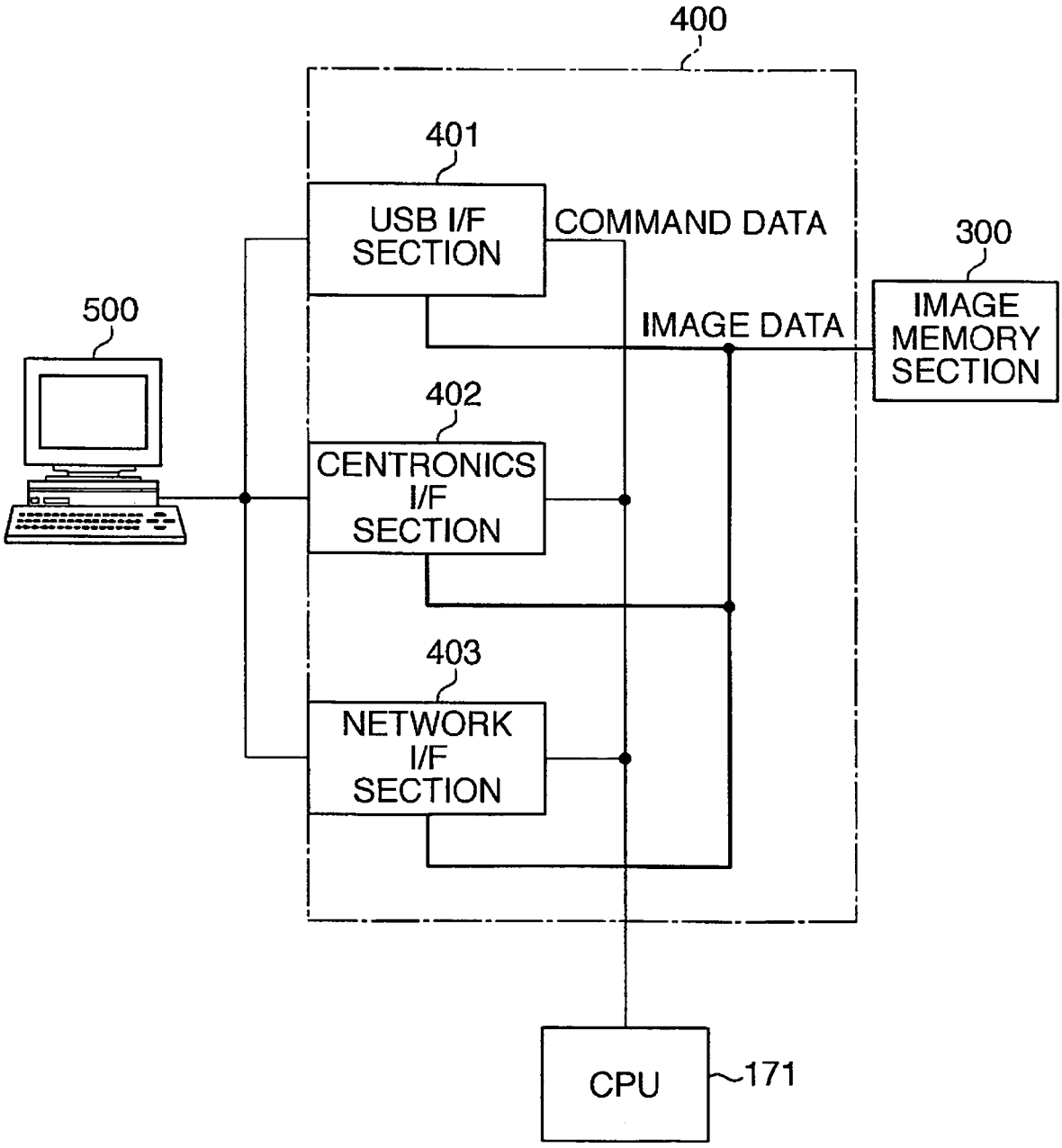
FIG. 4 is a block diagram showing the configuration of an external I/F processing section of FIG. 2 in detail.

FIG. 4 is a block diagram showing the configuration of the external I/F processing section 400 of FIG. 2 in detail.

In FIG. 4, the external I/F processing section 400 comprises a USB I/F section 401, a Centronics I/F section 402, and a network I/F section 403, which are connected to an external apparatus 500, the CPU 171, and the image memory section 300, respectively. The external apparatus 500 is a computer, a work station or the like.

The external I/F processing section 400 receives, via the USB I/F section 401, Centronics I/F section 402, or the network I/F section 403, image data and command data transmitted from the external apparatus 500.

The command data received from the external apparatus 500 is processed by the CPU 171. Based on the command data, the CPU 171 performs settings for execution of a print operation by using the image forming processing section 200, the input/output port 173 and the like, determination of various timing.

Image data received from the external apparatus 500 is transmitted to the image memory section 300 in timing determined based on the command data. The image forming processing section 200 performs an image formation process based on the image data.

The external I/F processing section 400 transmits information indicating the state of the full-color printer 1 and the like determined by the CPU 171 to the external apparatus 500 via the USB I/F section 401, the Centronics I/F section 402, or the network I/F section 403.

Hereunder, a description will be given of a standby position of transfer material P in double-sided printing of the full-color printer 1 shown in FIG. 1.

A double-sided print job is started when image data and command data for first side image formation are received from the external apparatus 500 by the external I/F processing section 400. Upon start of the first side image formation, a transfer material P is fed from the sheet feed cassette 17 or the manual sheet feed tray 20 to the secondary transfer section 34, and a toner image is transferred onto the transfer material P.

After completion of the first side image formation on the transfer material P, while the transfer material P passes through the double-sided path 43, the external I/F processing section 400 receives image data and command data for second side image formation from the external apparatus 500, whereas the full-color printer 1 starts preparation for the second side image formation.

In the case of an ordinary double-sided print job, the time necessary for execution of processes such as rasterization and compression of image data for second side image formation is shorter than the time necessary for completing predetermined steps of first side image formation. In this case, when the first side image formation is finished, a transfer material P is fed to the secondary transfer section 34 without being put on standby on the double-sided path 43, and then the second side image formation is performed.

There may be cases where the processes of rasterizing and compressing image data for the second side image formation take longer time than usual depending on the property of the image data. In this case, the external I/F processing section 400 cannot receive the image data and command data for the second side image formation from the external apparatus 500 before the transfer material P has passed through the double-sided path 43. Therefore, the second side image formation cannot be started immediately after completion of the first side image formation, and the transfer material P must be put on standby at a predetermined standby position on the double-sided path 43. When the external I/F processing section 400 receives the image data and command data for the second side image formation from the external apparatus 500, feeding of the transfer material P having been put on standby at the standby position is restarted, then the second side image formation is performed.

The standby position is always set at the same position so that timing of image formation on the transfer material P for which the feeding has been restarted will be the same irrespective of the size of the transfer material P, and specifically, so that the front edge of the transfer material P is always in the same position in the feeding direction upon restart of the feeding will be the same irrespective of the size of the transfer material P. The position of the trailing edge of the transfer material P varies depending on the size of the transfer material P.

Figure 5A:
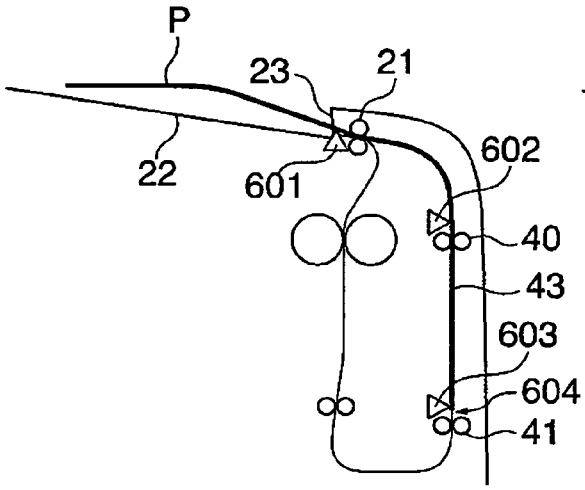
FIG. 5A is a diagram useful in explaining a standby position of a transfer material in the full-color printer of FIG. 1 at the time of double-sided printing.

FIG. 5A is a diagram showing the standby position of a transfer material P in the full-color printer of FIG. 1 at the time of double-sided printing.

In FIG. 5A, the transfer material P is in a standby state when the second side image formation cannot be performed immediately after completion of the first side image formation.

Referring to FIG. 5A, sensors 601, 602 and 603 for detecting the presence or absence of a transfer material P are provided on the double-sided path 43. The sensor 603 is disposed to face a standby position 604 of transfer material P. A discharge port 23 as an exit to the discharge tray 22 is further provided on the double-sided path 43.

The front edge (as viewed in the feeding direction after the restart of transfer material feeding) of the inverted transfer material P is on standby at the standby position 604. The length of the transfer material P in the feeding direction is longer than the distance measured from the standby position 604 to the discharging roller 21 by way of the double-sided path 43 (ditto hereunder), so that a trailing edge portion of the transfer material P is exposed to the outside of the full-color printer 1.

On the double-sided path 43, the sensor 601 is provided in proximity to the discharge port 23, the sensor 603 is provided at the position of the standby position 604 as mentioned above, and the sensor 602 is provided at an intermediate position between these sensors 601 and 603.

Figure 5B:
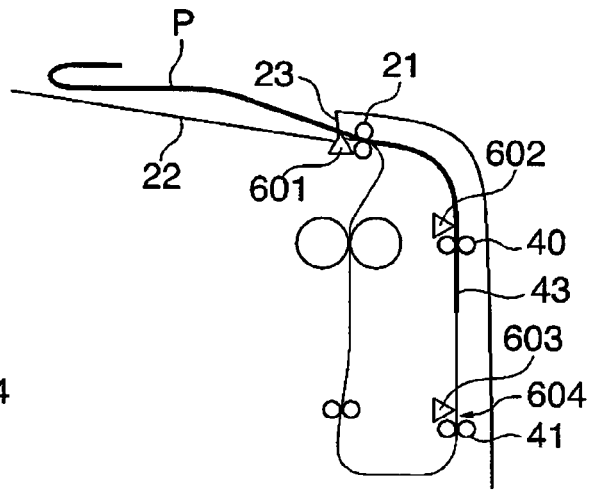
FIG. 5B is a diagram showing a state of a transfer material P when a first sensor is off.
Figure 5C:
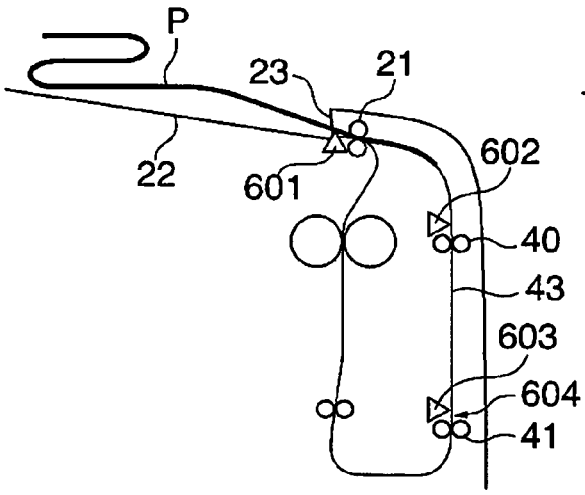
FIG. 5C is a diagram showing a state of the transfer material P when a second sensor is off.
Figure 5D:
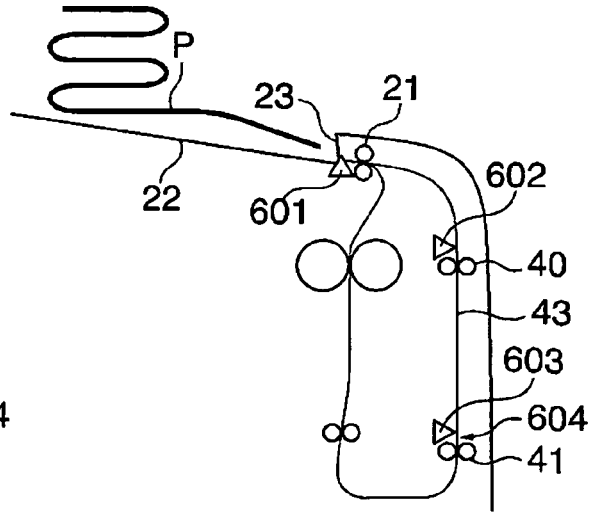
FIG. 5D is a diagram showing a state of the transfer material P when a third sensor is off.

FIG. 5B is a diagram showing the state of the transfer material P when the sensor 603 is off, FIG. 5C is a diagram showing the state of the transfer material P when the sensor 602 is off, and FIG. 5D is a diagram showing the state of the transfer material P when the sensor 601 is off.

Each of the sensors 601, 602 and 603 is on when there is a transfer material P within a sensing zone of the sensor, whereas the sensor is off when no transfer material P is present within its sensing zone. The CPU 171 recognizes whether the sensors 601, 602 and 603 are on or off based on signals supplied from these sensors via the input/output port 173.

When a transfer material P is on standby at the standby position 604, all the sensors 601, 602 and 603 are on. If the user mistakenly pulls out the transfer material P, they become off in order of the sensors 603, 602 and 601, whereby the CPU 171 can recognize that the transfer material P is being pulled out.

Figure 6A:
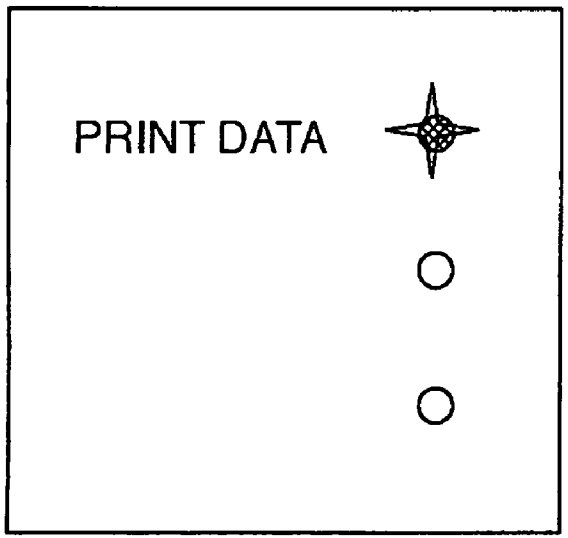
FIG. 6A is a diagram showing an alarm display by an LED of an operating section of FIG. 2.
Figure 6B:
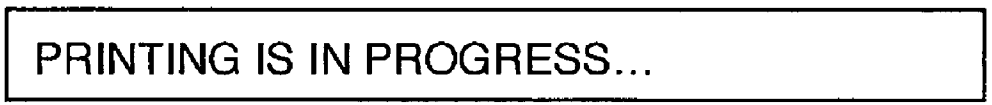
FIG. 6B is a diagram showing an alarm display by character information.
Figure 6C:
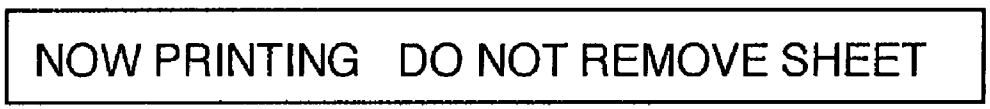
FIG. 6C is a diagram showing another alarm display by character information.

On recognizing that the sensor 603 is off, the CPU 171 changes the display content of an operating section 172 and warns the user to stop pulling out the transfer material P. The way of warning may be either blinking an LED on the operating section 172 as shown in FIG. 6A, or displaying character information indicating that printing is being performed on the operating section 172 as shown in FIG. 6B, or displaying character information warning not to pull out the transfer material P on the operating section 172 as shown in FIG. 6C. It is also possible to warn the user to stop pulling out the transfer material P by a warning beep or voice.

The user can set whether or not a warning should be given when the sensor 603 is off.

Furthermore, on recognizing that all the sensors are off, the CPU 171 determines that the transfer material P is completely pulled out of the printer 1, and performs a display of the operating section 172 to the effect that image forming operation cannot be continued. It is also possible, by a warning beep or voice, to notify the user that the image forming operation cannot be continued.

Figure 7:
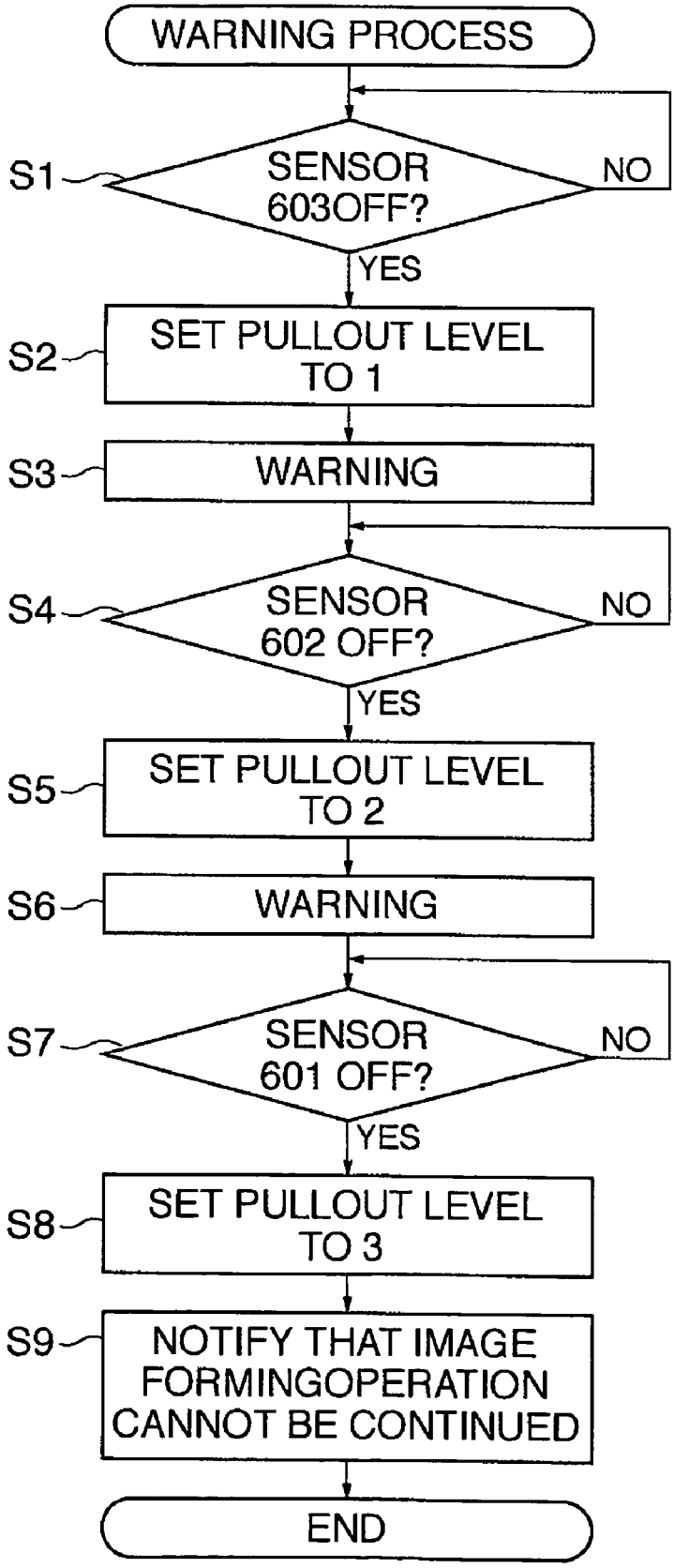
FIG. 7 is a flowchart showing a procedure of a warning process executed by a CPU of FIG. 2.

FIG. 7 is a flowchart showing the procedure of a warning process executed by the CPU 171 of FIG. 2.

This process is performed when a transfer material P is on standby at the standby position 604 after the first side image formation is completed.

On recognizing that the sensor 603 is off in FIG. 7 (YES to step S1), the CPU 171 sets a pullout level stored in the RAM 175 at 1 (step S2). The CPU 171 changes the display content of the operating section 172 to warn the user to stop pulling out the transfer material P (step S3).

Next, on recognizing that the sensor 602 is off (YES to step S4), the CPU 171 sets the pullout level stored in the RAM 175 at 2 (step S5). The CPU 171 further changes the display content of the operating section 172 to further warn the user to stop pulling out the transfer material P (step S6).

Next, on recognizing that the sensor 601 is off (YES to step S7), the CPU 171 sets the pullout level stored in the RAM 175 at 3 (step S8). The CPU 171 further changes the display content of the operating section 172 to notify the user that the transfer material P is completely pulled out of the full-color printer 1 and thus the image forming operation cannot be continued (step S9), whereupon this process is completed.

According to the process of FIG. 7, on recognizing that the sensor 603 or 602 is off (YES to step S1 or S4), the CPU 171 changes the display content of the operating section 172 to warn the user to stop pulling out the transfer material P (steps S3 or S6). Therefore, it is possible to have the user stop pulling out the sheet if the sheet on standby is started to be pulled out by the user after the first side printing has been completed in double-sided printing.

It is also possible to change the type of warning according to the pullout level set up in the steps S2, S5 and S8.

Figure 8:
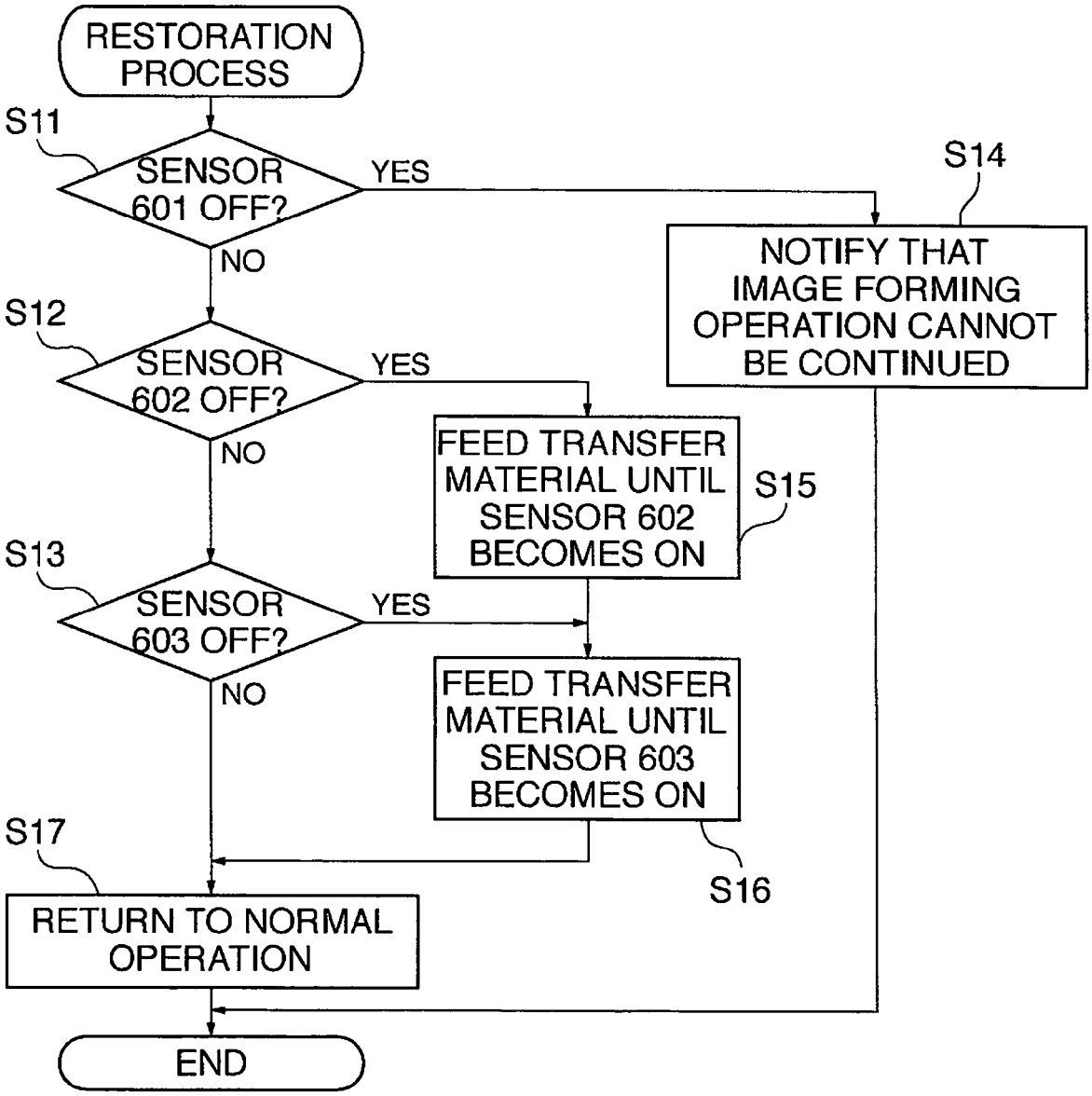
FIG. 8 is a flowchart showing a procedure of a restoration process executed by the CPU of FIG. 2.

FIG. 8 is a flowchart showing the procedure of a restoration process executed by the CPU 171 of FIG. 2.

This process is executed when the user stops pulling out the transfer material P on standby.

In FIG. 8, the CPU 171 determines whether or not the sensor 601 disposed nearest the discharge port 23 is off (step S11), and further determines whether or not the sensor 602 is off when it is determined that the sensor 601 is on (step S12). The CPU 171 further determines whether or not the sensor 603 is off when the sensor 602 is determined to be on (step S13).

When the sensor 603 is determined to be on as a result of the determination in the step S13, the transfer material P is not pulled out but is on standby at the standby position 604 as shown in FIG. 5A. Therefore, the CPU 171 restores the image forming apparatus to normal operation (step S17), completing this process.

When the sensor 603 is determined to be off as a result of the determination in the step S13, the transfer material P is pulled out to a position between the sensors 603 and 602 as shown in FIG. 5B. In this case, the CPU 171 causes the discharging roller 21 and the double-sided roller 40 to feed the transfer material P until the sensor 603 becomes on (step S16). As a result, the transfer material P is returned to the standby position 604, and thus the CPU 171 restores the image forming apparatus to the normal operation and resets to the pullout level to the initial value, e.g., zero (step S17), whereupon this process is completed.

When the sensor 602 is determined to be off as a result of the determination in the step S12, the transfer material P is pulled out to a position between the sensors 602 and 601 as shown in FIG. 5C. In this case, the CPU 171 causes the discharging roller 21 to feed the transfer material P until the sensors 602 and 603 become on (steps S15, S16), completing this process.

When the sensor 601 is determined to be off as a result of the determination in the step S11, the transfer material P is completely pulled out of the full-color printer 1 as shown in FIG. 5D. In this case, the CPU 171 changes the display content of the operating section 172 to notify the user that the image forming operation of the transfer material P cannot be continued (step S14), completing this process. Even in that case, the image forming process of the next transfer material P' can be continued, and therefore, after elapse of a predetermined time, the display content of the operating section 172 may be returned to the display in a normal state or at the time of starting a job.

According to the process of FIG. 8, when the sensor 603 or 602 is off (YES to steps S12 or S13), the transfer material P is fed until the sensors 602 and 603 become on (steps S15, S16). Therefore, even if the sheet on standby is partly pulled out by the user after the first side printing is finished in double-sided printing, the second side printing can be normally carried out.

In this embodiment, when the sensor 603 or the sensors 602, 603 are determined to be off, the transfer material P is fed to the standby position 604 until the sensor 603 or the sensors 602, 603 are on. Alternatively, according to the pullout level acquired by the warning process of FIG. 7, the transfer material P may be fed to the standby position 604 until the initial pullout level is reached.

Instead of carrying out the process of FIG. 8, the timing of second side image formation may be changed or adjusted according to the pullout level acquired by the warning process of FIG. 7 to fit the timing in which the pulled-out transfer material P reaches the secondary transfer section 34.

Hereunder, the image forming apparatus according to a second embodiment of the present invention will be described.

The image forming apparatus according to the present embodiment is only different from the first embodiment in that an encoder 701 for measuring an amount of rotation of the discharging roller 21 is provided to the discharging roller 21. In the present embodiment, the sensors 601 to 603 on the double-sided path 43 are not inevitably necessary.

Figure 9:
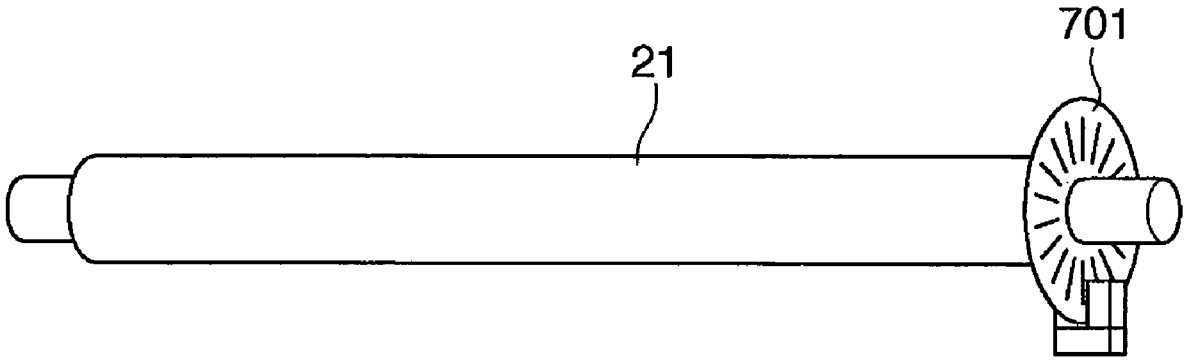
FIG. 9 is a perspective view of a discharging roller of the image forming apparatus according to a second embodiment of the present invention.

FIG. 9 is a perspective view of the discharging roller 21 of the image forming apparatus according to the second embodiment of the present invention.

In FIG. 9, the discharging roller 21 comprises the encoder 701 for measuring the amount of rotation of the discharging roller 21.

If the transfer material P on standby at the standby position 604 is pulled out by the user, the discharging roller 21 rotates, and the encoder 701 detects a pullout amount indicating the amount by which the transfer material P is pulled out. The CPU 171 acquires the pullout amount via the input/output port 173, and changes the display content of the operating section 172 according to the pullout amount so as to warn the user to stop pulling out the transfer material P.

The CPU 171 determines whether or not the transfer material P is completely pulled out of the full-color printer 1 based on the acquired pullout amount. When the transfer material P is completely pulled out of the full-color printer 1, the CPU 171 changes the display content of the operating section 172 to notify the user that the image forming operation of the transfer material P cannot be continued.

When the transfer material P is not completely pulled out of the full-color printer 1, the CPU 171 causes the transfer material P to be fed in a direction to return the transfer material P to the standby position 604 as much as it has been pulled out based on the pullout amount detected by the encoder 701. Thus, the transfer material P is returned to the standby position 604, and then the CPU 171 restores the image forming apparatus to the normal operation.

According to the second embodiment, the transfer material P is fed as much as it has been pulled out based on the pullout amount detected by the encoder 701. Therefore, it is possible to normally carry out the second side printing even if the sheet on standby is pulled out by the user after the first side printing is finished in double-sided printing.

The image forming apparatus according to the present invention has been described by taking the full-color printer as an example. However, the present invention is not limited thereto but is also applicable to the apparatuses such as a monochrome printer and a copying machine used for image formation on both sides of transfer material.

It is to be understood that the object of the present invention may also be accomplished by supplying a system or an apparatus with a storage medium in which a program code of software which realizes the functions of either of the above described embodiments is stored, and causing a computer (or CPU or MPU) of the system or apparatus to read out and execute the program code stored in the storage medium.

In this case, the program code itself read out from the storage medium realizes the functions of either of the above described embodiments, and hence the program code and the storage medium in which the program code is stored constitute the present invention.

Examples of the storage medium for supplying the program code include a floppy (registered trademark) disk, a hard disk, a magnetic-optical disk, optical disks such as a CD-ROM, a CD-R, a CD-RW, a DVD-ROM, a DVD-RAM, a DVD-RW or a DVD+RW, a magnetic tape, a nonvolatile memory card, and a ROM. Further, the program code may be downloaded via a network.

Further, it is to be understood that the functions of either of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of either of the above described embodiments may be accomplished by writing a program code read out from the storage medium into a memory provided in an expansion board inserted into a computer or in an expansion unit connected to the computer and then causing a CPU or the like provided in the expansion board or the expansion unit to perform a part or all of the actual operations based on instructions of the program code.

This application claims the benefit of Japanese Application No. 2005-159859, filed May 31, 2005, which is hereby incorporated by reference herein in its entirety.

What is claimed is:

1. An image forming apparatus comprising:

a sheet feeding device that feeds a transfer material;

a receiving device that receives image data;

an image forming device that forms an image on a first side and a second side of the fed transfer material based on the image data received by said receiving device;

an inversion device that feeds the transfer material having the image formed on the first side thereof until the transfer material is partly exposed to outside of the image forming apparatus and then feeds the transfer material to a refeeding path in the image forming apparatus;

a refeeding device that feeds the transfer material inverted by said inversion device to a standby position and causes the transfer material to stop at the standby position for image formation on the second side of the transfer material;

a determining device that determines whether or not preparation for image formation on the second side of the transfer material is completed;

a pullout detecting device that detects the transfer material caused to stop at the standby position by said refeeding device being pulled out by a user; and a warning device that gives the user a warning to stop pulling out the transfer material when the transfer material being pulled out is detected by said pullout detecting device.

2. The image forming apparatus according to claim 1, wherein said pullout detecting device detects a degree of the transfer material being pulled out, and said warning device changes type of the warning according to the detected degree of the transfer material being pulled out.

3. The image forming apparatus according to claim 2, wherein said refeeding device feeds the transfer material to the standby position based on the degree of the transfer material being pulled out detected by said pullout detecting device.

4. The image forming apparatus according to claim 2, wherein said warning device notifies the user that image forming operation on the transfer material cannot be continued when it is detected by said pullout detecting device that the transfer material is completely pulled out.

5. The image forming apparatus according to claim 1, comprising a setting device that sets whether or not the warning device should give the warning.

6. The image forming apparatus according to claim 1, wherein said warning device notifies the user that the transfer material is kept stopped at the standby position.

7. A control method for an image forming apparatus comprising:

a sheet feeding step of feeding a transfer material;

a receiving step of receiving image data;

an image forming step of forming an image on a first side and a second side of the fed transfer material with the image forming apparatus based on the image data received in said receiving step;

an inversion step of feeding the transfer material having the image formed on the first side thereof until the transfer material is partly exposed to outside of the image forming apparatus and then feeding the transfer material to a refeeding path in the image forming apparatus;

a refeeding step of feeding the transfer material inverted in said inversion step to a standby position and causing the transfer material to stop at the standby position for image formation on the second side of the transfer material;

a determining step of determining whether or not preparation for image formation on the second side of the transfer material is completed;

a pullout detecting step of detecting the transfer material caused to stop at the standby position in said refeeding step being pulled out by a user; and a warning step of giving the user a warning to stop pulling out the transfer material when the transfer material being pulled out is detected in said pullout detecting step.

8. The control method according to claim 7, wherein said pullout detecting step detects a degree of the transfer material being pulled out, and said warning step changes type of the warning according to the detected degree of the transfer material being pulled out.

9. The control method according to claim 8, wherein said refeeding step feeds the transfer material to the standby position based on the degree of the transfer material being pulled out detected in said pullout detecting step.

10. The control method according to claim 8, wherein said warning step notifies the user that image forming operation on the transfer material cannot be continued when it is detected in said pullout detecting step that the transfer material is completely pulled out.

11. The control method according to claim 7, comprising a setting step of setting whether or not the warning should be given in said warning step.

12. The control method according to claim 7, wherein said warning device notifies the user that the transfer material is kept stopped at the standby position.

* * * * *